US010954715B2

(12) United States Patent
O'Shea

(10) Patent No.: US 10,954,715 B2
(45) Date of Patent: Mar. 23, 2021

(54) ADJUSTABLE DOOR SWEEP

(71) Applicant: James O'Shea, Wildwood, MO (US)

(72) Inventor: James O'Shea, Wildwood, MO (US)

( * ) Notice: Subject to any disclaimer, the term of this patent is extended or adjusted under 35 U.S.C. 154(b) by 126 days.

(21) Appl. No.: 16/263,533

(22) Filed: Jan. 31, 2019

(65) Prior Publication Data

US 2020/0248500 A1 Aug. 6, 2020

(51) Int. Cl.
*E06B 7/22* (2006.01)
*E06B 7/23* (2006.01)

(52) U.S. Cl.
CPC ..... *E06B 7/2316* (2013.01)

(58) Field of Classification Search
CPC ..... E06B 7/16; E06B 7/22; E06B 7/23; E06B 7/2316
USPC ..... 49/467–471
See application file for complete search history.

(56) References Cited

U.S. PATENT DOCUMENTS 2,568,477 A * 9/1951 Westlund ..... E05C 17/44 292/288
2,949,651 A * 8/1960 Hill ..... E06B 7/2316 49/493.1
4,488,387 A * 12/1984 Foti ..... E06B 7/22 49/425
4,497,136 A * 2/1985 Khallil ..... E06B 7/16 49/480.1
5,150,544 A * 9/1992 Burnett ..... E06B 7/22 49/470
6,058,654 A * 5/2000 Rissone ..... E06B 7/16 49/303
6,378,250 B1 * 4/2002 Yen ..... E06B 7/2316 49/310
6,442,901 B1 * 9/2002 Rissone ..... E06B 7/2316 49/469
8,381,448 B2 * 2/2013 Flory ..... E06B 7/215 49/468
2010/0083581 A1 * 4/2010 Mattice ..... H02G 3/22 49/475.1
2012/0222361 A1 * 9/2012 Farucci ..... E06B 7/2316 49/475.1

* cited by examiner

*Primary Examiner* — Joshua E Rodden

(57) ABSTRACT

The present invention is an adjustable door sweep that would be available as either an accessory attached to the bottom exterior of a door or as an integrated component installed inside a newly manufactured door. Both embodiments would feature sweep bristles stored vertically in the housing, running the width of the door, and protruding from a half-inch aperture on the bottom of the door itself or attached accessory. When deployed from the bottom of the door or accessory, the individual bristles would conform perfectly to the exact contour of the threshold surface, regardless if it is natural or man-made, then be locked in place by the present invention.

14 Claims, 6 Drawing Sheets

ADJUSTABLE DOOR SWEEP

FIELD OF THE INVENTION

The present invention generally relates to door sweeps and seals, and more specifically relates to door sweeps that are adjustable.

BACKGROUND OF THE INVENTION

The installation of a hinged door often results in gaps between the threshold (whether manufactured or natural ground surface) and the bottom of the door. To prevent, or at least mitigate, the migration of insects, snakes, rodents, dust, leaves, etc. from entering via those gaps, devices such as weather stripping, seals, and traditional door sweeps have been utilized. However, such devices are typically either a.) a predetermined, non-adjustable height and therefore may not close the gap or b.) have an adjustable height but is unable to conform to the slope and/or contour of the threshold surface.

SUMMARY OF INVENTION

The present invention is an adjustable door sweep capable of conforming to the exact slope and contour of the threshold surface, whether natural or man-made. It can be provided as an add-on accessory to an existing door or be integrated into a newly manufactured door. These and other features, aspects and advantages of the present invention will become better understood with reference to the following drawings, descriptions, and claims.

DETAILED DESCRIPTION

Figure 1:
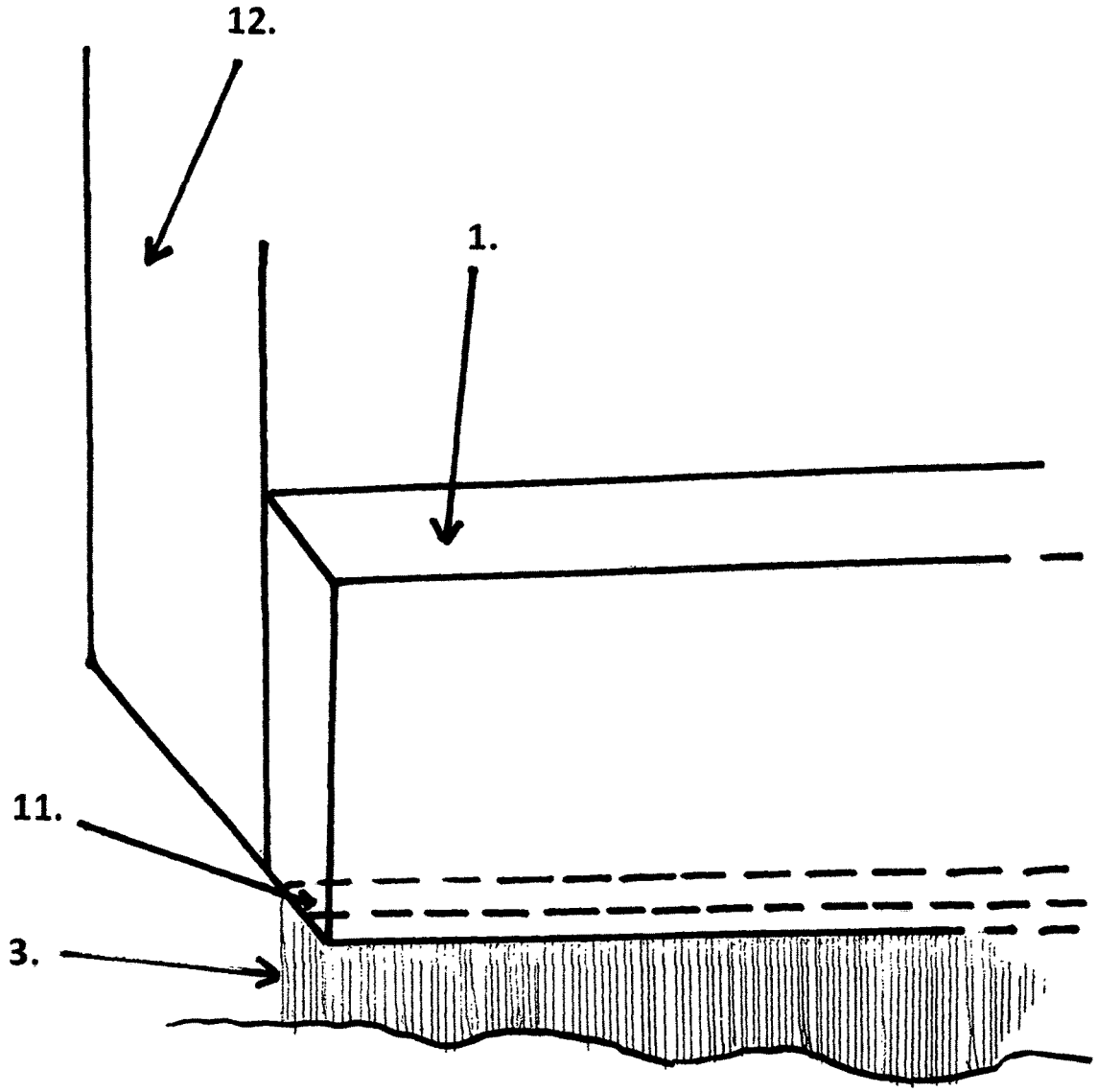
FIG. 1 is an elevational, angled front view of an existing door embodying the present invention as an add-on accessory.

The first embodiment of the present invention is an adjustable door sweep designed to be attached to the bottom of a hinged door as an accessory. Said adjustable door sweep comprises a hollow aluminum housing one inch thick and three inches tall, with a half inch wide aperture across its bottom horizontal surface. The length of the housing and its components would correspond to the width of a door, extending along and adjacent to bottom of said door. The hollow aluminum housing comprises a horizontal plate spanning the thickness of the housing mounted one half inch from its top and spanning its entire length, featuring multiple grooves (plate carrier channels), a two inch high aluminum pressure plate also spanning the entire length of the housing with Y-shaped appendages (plate carrier flanges) on the top that would ride inside the plate carrier channels, an approximate half inch thick bundle of loose, two and one half inch long nylon sweep bristles embedded inside the housing vertically and spanning the entire length of the housing, multiple set screws (depending on the width of the specific door it's attached to) used to hold the pressure plate into position thereby locking the nylon sweep bristles in place, multiple retraction springs (depending on the width of the specific door it's attached to) used pull the pressure plate back once the set screws are loosened so that the sweep bristles are free to gravitationally deploy, multiple (depending on the width of the door) threaded holes and screw channels for the set screws to travel and, plastic hole plugs designed to conceal the screw heads.

The first embodiment of the present invention includes a method of using the adjustable door sweep such as that just described. The method includes attaching the adjustable door sweep onto the bottom of a door with multiple machine screws (depending on width of door) that fasten the inside vertical surface of the aluminum housing to the bottom exterior of the door. Once the adjustable door sweep is attached and the door is in the closed position, the pressure plate is relaxed by backing out the set screws in the housing which enables the retraction springs to pull the pressure plate away from the bristles. With pressure no longer holding them in place, the nylon sweep bristles are free to drop down through the aperture at the bottom of the housing. These individual sweep bristles will each drop down as far as they can, and vary in travel depending on the contour of the threshold surface below. Once the bristles are all in contact with the threshold surface, the pressure plate is retightened via the set screws which locks the bristles in place, thus providing a sweep perfectly conformed to the contour of the threshold. Plastic screw hole caps are then attached covering the set screw holes in the cover.

The second embodiment of the present invention is an adjustable door sweep integrated into the hollow interior of the bottom three inches of a newly manufactured, hinged door. Said adjustable door sweep comprises a hollow aluminum housing whose exterior thickness corresponds to the interior thickness of the door. Housing would be three inches high, with a half-inch wide aperture across its bottom surface, and be installed inside the hollow opening in the bottom of the door. The length of the housing and its components would correspond to the width of the door it is installed in, extending along and inside the bottom of said door. The housing comprises multiple (depending on door width) holes and threaded screw sleeves running along its vertical surface, with each hole in the housing corresponding to a matching hole in the door's exterior surface. The housing would include a horizontal plate mounted 2.5" from its bottom, spanning the door's width and featuring multiple grooves (plate carrier channels), a two inch high pressure plate also running the width of the door with multiple Y-shaped appendages (plate carrier flanges) across the top that would ride inside the plate carrier channels, an approximate ½" thick bundle of loose, 2.5" long nylon sweep bristles embedded inside the door vertically and spanning its entire width, multiple set screws (depending on the width of the specific door) used to hold the pressure plate into position thereby locking the nylon sweep bristles in place, multiple retraction springs (also depending on the width of the door) used to pull the pressure plate back once the set screws are backed out so that the sweep bristles are free to gravitationally deploy down through the aperture, and plastic hole plugs to conceal the screw heads.

The second embodiment of the present invention includes a method of using the adjustable door sweep such as that described. The method includes deploying the sweep bristles through the housing's aperture at the bottom of the door to conform to the threshold surface when the door is closed. The set screws holding the pressure plate (and thus the bristles) in place are backed off which causes the retraction springs to pull back the pressure plate, allowing the sweep bristles to gravitationally deploy through the aperture. Each nylon bristle will drop down as far as it can but will vary in travel depending on the contour of the surface below. Once the bristles are all in contact with the threshold surface the pressure plate is retightened, thereby locking the bristles in place and forming a door sweep that perfectly conforms to the threshold surface. The screw hole caps are then attached covering the screw heads.

Other objects and purposes of the invention, and variations thereof, will be apparent upon reading the following specification and inspecting the accompanying drawings.

DETAILED DESCRIPTION OF DRAWINGS

FIG. 1 shows an elevational angled front view of the bottom of an exterior door (12) with the present invention attached as an accessory. The adjustable door sweep's bristles (3) are shown protruding from the aperture (11) in the housing (1) and deployed over a threshold surface that is both uneven and slopes away from the hinged side of the door, as in the case in most patios and decks.

Figure 2:
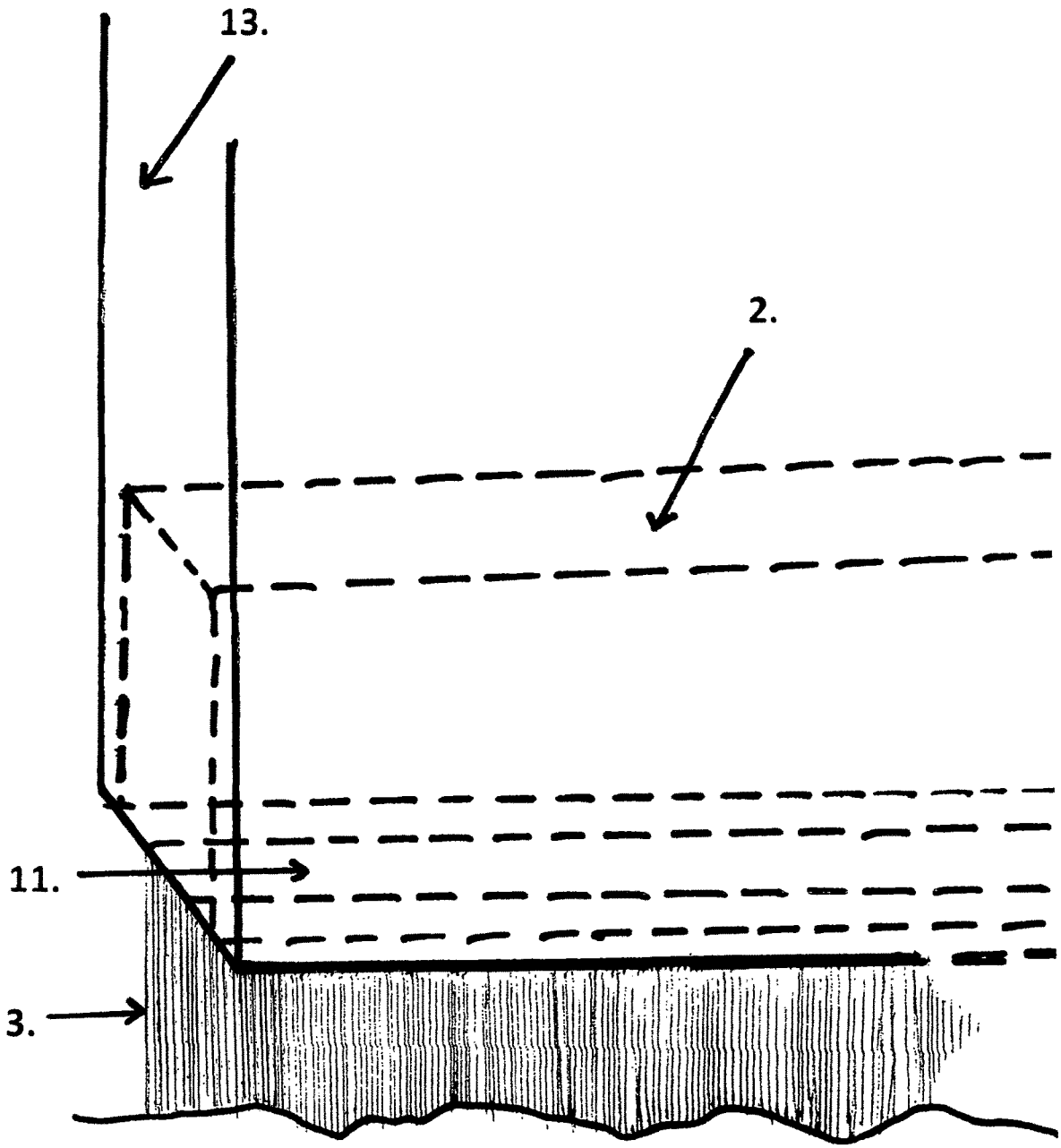
FIG. 2 is an elevational, angled front view of a newly-manufactured door embodying the present invention as an integrated component of said door.

FIG. 2 shows an elevational angled front view of the bottom of a newly manufactured door (13) with the present invention, depicting the housing only, not all components, installed as an integrated component of said door. The adjustable door sweep's bristles (3) are shown protruding from the aperture (11) and deployed over a threshold surface that is both uneven and slopes away from the hinged side of the door as in the case in most patios and decks.

Figure 3:
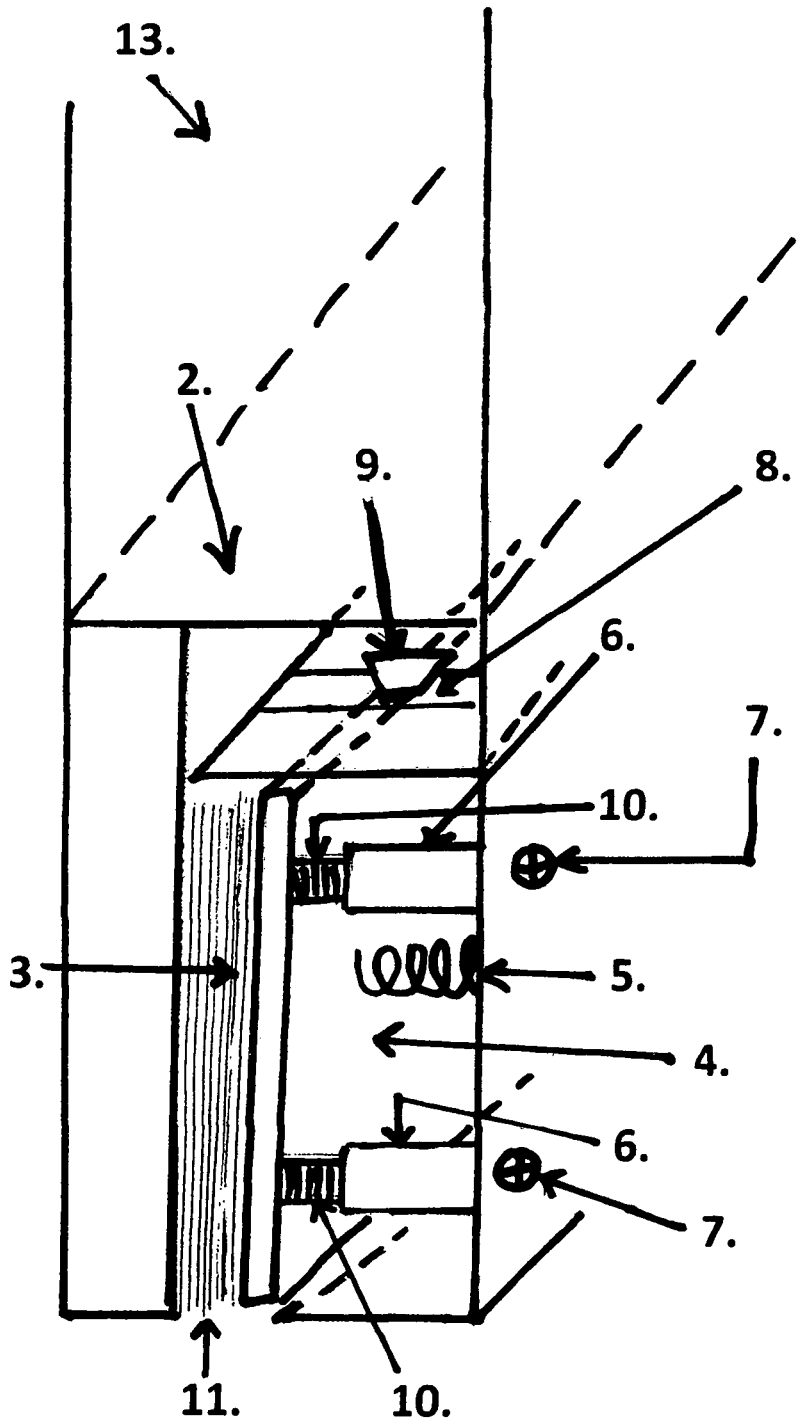
FIG. 3 is an elevational side view of the present invention as the integrated component of a door and with sweep bristles not deployed.

FIG. 3 shows a cross-sectional side view of the present invention installed as an integrated component inside a newly manufactured door (13). The view depicts undeployed sweep bristles (3) inside the housing (2) and above an aperture (11) in the door's hollow bottom and being held in place by the pressure plate (4). The right side of the drawing shows the set screws (10) used to, in conjunction with the pressure plate (4), lock the nylon sweep bristles (3) in place prior to deployment. The pressure plate flange (9) and plate carrier channel (8) guide the pressure plate (4) back and forth. The retraction spring (5) is used to pull the pressure plate (4) back to enable deployment of the bristles (3) once the set screws (10) are backed out. Advancing the set screws (10) inside the set screw sleeves (6) pushes the pressure plate (4) back into position, thereby holding the bristles in position. Plastic hole caps (7) are used to hide the set screw holes.

Figure 4:
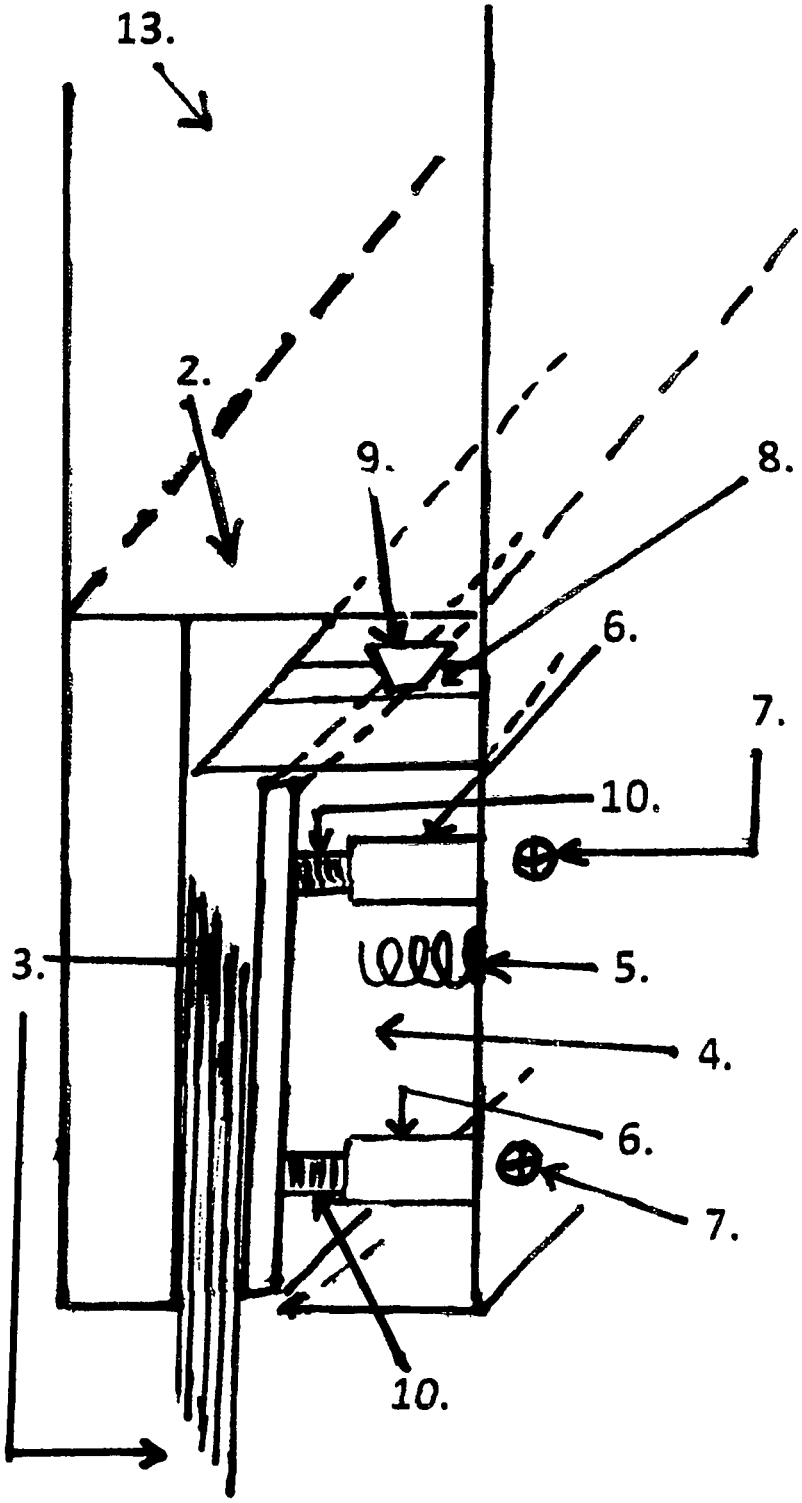
FIG. 4 is an elevational side view of the present invention as an integrated component of a door and with sweep bristles deployed over an uneven threshold surface.

FIG. 4 is a version of FIG. 3 with the present invention's bristles (3) gravitationally deployed unevenly from the housing (2) and contouring to the threshold surface.

Figure 5:
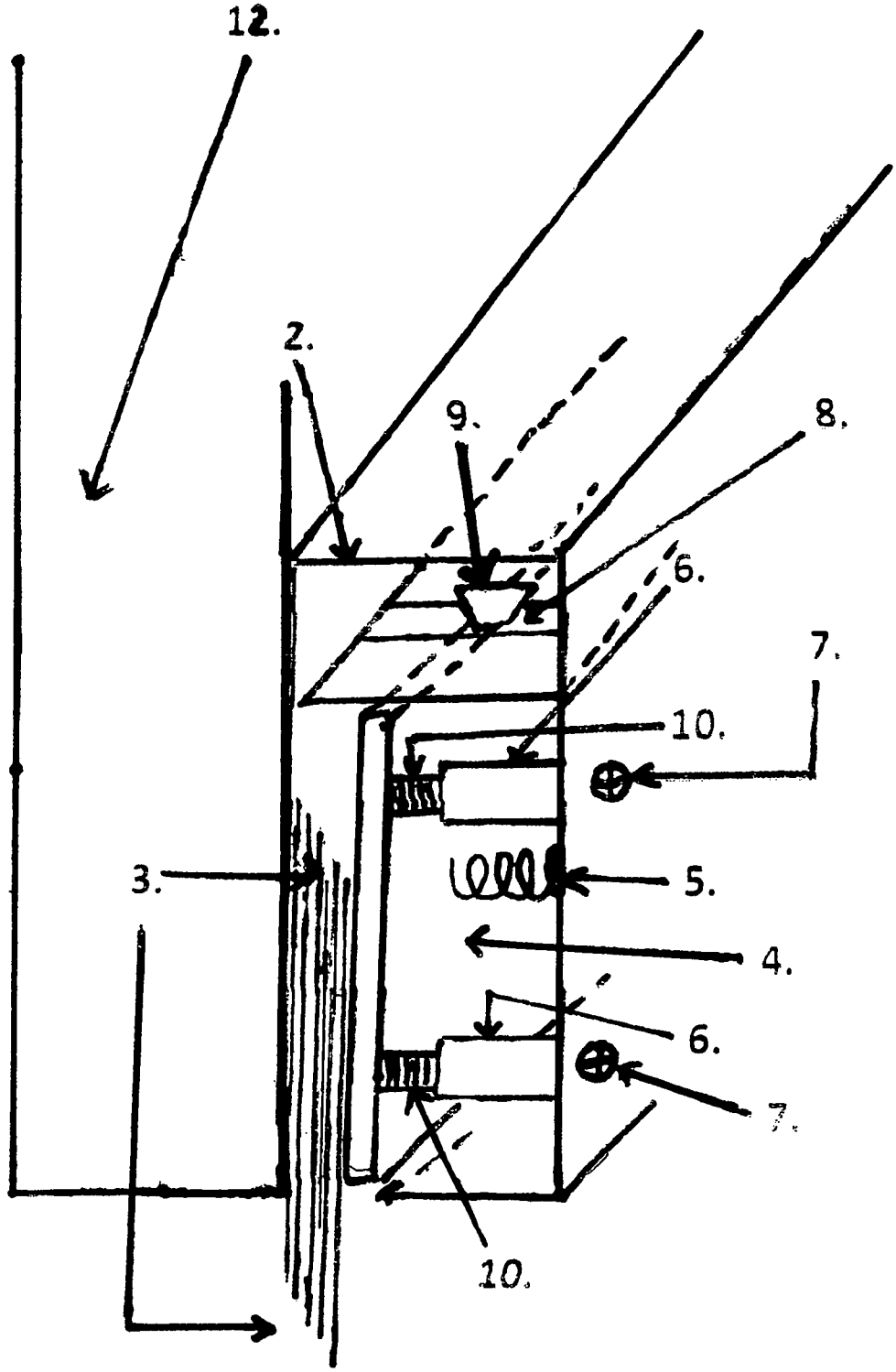
FIG. 5 is an elevational side view of the present invention as an add-on accessory attached to an existing door and with sweep bristles deployed over an uneven threshold surface.

FIG. 5 shows is an angled side view of the present invention installed as an accessory to an existing exterior door (13). The left side shows the bottom of the exterior door and the right side shows the present invention's housing (2) attached to said door. Sweep bristles (3) are shown deployed through the aperture in the housing (2) bottom and held in place by the set screws (10) and pressure plate (4). The remaining components are consistent with FIG. 3 and FIG. 4.

Figure 6:
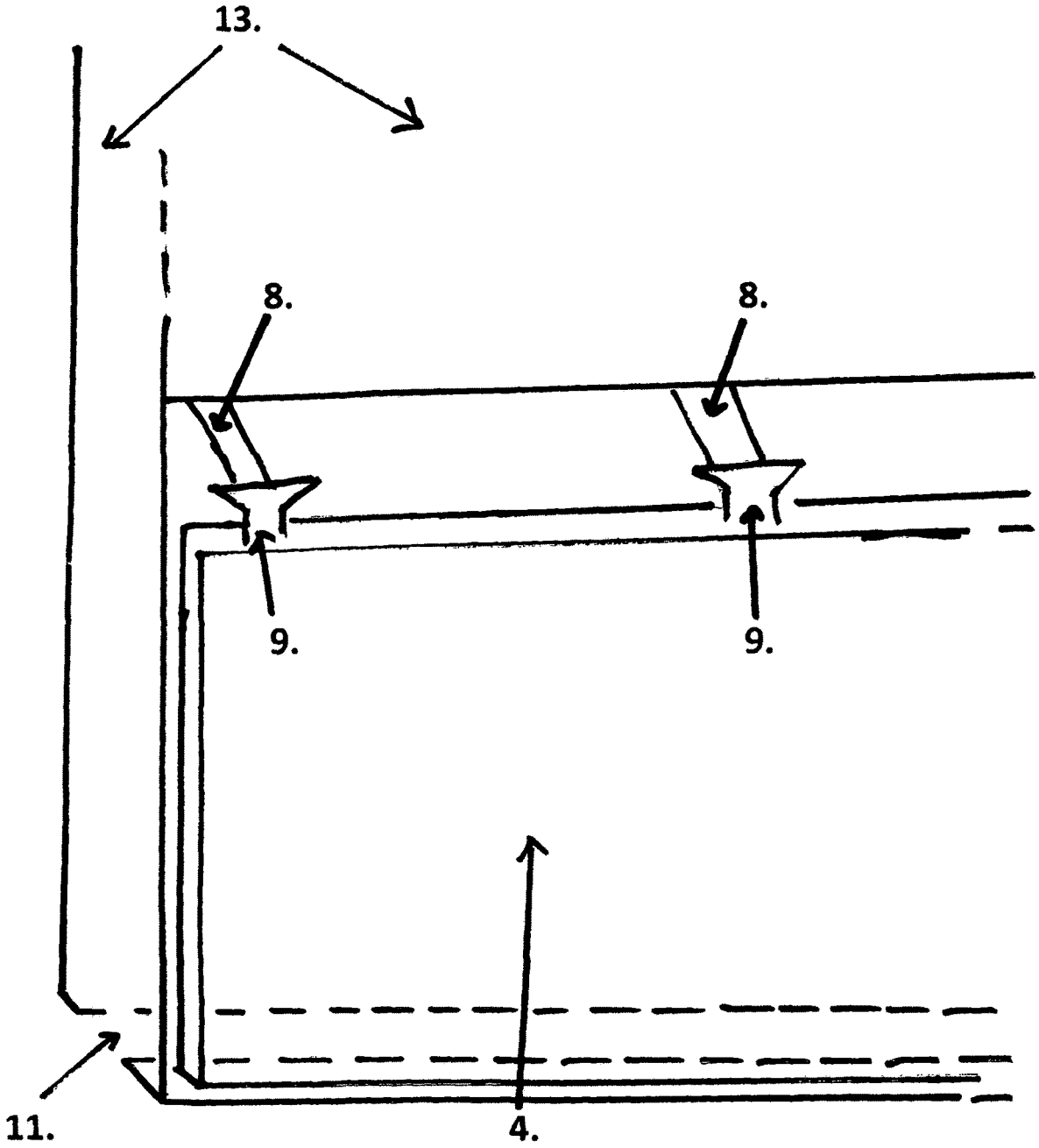
FIG. 6 is a cross-sectional front view of the present invention showing the pressure plate flanges engaged with the plate carrier channels.

FIG. 6 shows the pressure plate's flanges (9) engaged in the plate carrier channels (8). The channels enable the pressure plate (4) to move horizontally either backward to release pressure on the sweep bristles and enabling deployment, or forward to lock the deployed sweep bristles in place.

PRIOR ART

| | Adjustable Vertically | Self-Adjustable | Adjustable to Slope | Adjustable to Uneven Surface |
|---|---|---|---|---|
| Present Invention | X | X | X | X |
| U.S. Pat. No. 8,381,448 | X | | | |
| U.S. Pat. No. 5,174,065 | X | | | |
| U.S. Pat. No. 5,056,263 | X | X | | |

ADVANTAGES OF INVENTION

The above-described present invention and method of using the present invention (both embodiments) provide advantages over other adjustable door sweeps available on the market. The present invention is easy to manufacture, install, and use. Moreover, the above-described adjustable door sweep (both embodiments) allows its vertically positioned nylon bristles (sweep) to move independently of each other in order to exactly conform to virtually any threshold surface the door closes over, preventing or at least mitigating, insects, small animals such as mice or snakes, or any dirt or plant material from entering via wind or other factors. The adjustable door sweep's ability to be provided as either an add-on door accessory or integral to a newly manufactured door is another clear advantage of present invention.

Although particular preferred embodiments of the invention have been disclosed in detail for illustrative purposes, it will be recognized that variations or modifications of the disclosed apparatus, including the rearrangement of parts and their applications, lie within the scope of the present invention.

I claim:

1. An adjustable door sweep comprising: a housing with a length configured to correspond to a length of a door and extend along and adjacent to a bottom of said door, and an aperture spanning the length of the housing; an interior of the housing includes a horizontal frame member set below a top of the housing and also spanning the length of the housing; a plurality of plate carrier channels cut into the frame member, each carrier channel spanning a thickness of the housing; a pressure plate running the length of the housing and including a plurality of Y-shaped plate carrier flanges affixed to a top of the plate that seat inside and travel along respective ones of the plate carrier channels, permitting the pressure plate to move back and forth; a bundle of loose, high nylon or Teflon-coated nylon bristles stored inside the housing vertically and spanning the length of the housing; a plurality of retraction springs attached to the pressure plate and an interior front wall of the housing; a plurality of holes in the housing, each hole having a corresponding one of a screw sleeve, a set screw, and a plastic hole cap.

2. The sweep as described above in claim 1, wherein the housing is aluminum and wherein the thickness of the housing is one inch thick and the housing is three inches high.

3. The sweep as described above in claim 1, wherein the aperture of the housing is a half-inch wide.

4. The sweep as described above in claim 1, wherein the horizontal frame member is set one half inch below the top of the housing.

5. The sweep as described above in claim 1, wherein the pressure plate is aluminum and wherein the pressure plate is two inches high and a quarter inch thick.

6. The sweep as described above in claim 1, wherein the bundle is a half-inch thick.

7. An adjustable door sweep comprising: a housing with an exterior thickness configured to correspond to an interior thickness of a hollow bottom of a door and a length configured to correspond to a length of the door and extending along and adjacent to a bottom of said door, and an aperture spanning a full length of bottom horizontal face of the housing; a horizontal frame member set below a top of housing and spanning both the thickness and the length of the housing; a plurality of plate carrier channels cut into the horizontal frame member, each of the plate carrier channels spanning the thickness of the housing; a pressure plate spanning the length of the housing including a plurality of Y-shaped plate carder flanges affixed to a top of the plate that seat inside and travel along and within respective ones of the plate carder channels, permitting the pressure plate to move back and forth; a bundle of loose, nylon or Teflon-coated nylon bristles stored inside the housing vertically and spanning the length of the housing; a plurality of retraction springs attached to the pressure plate and an interior front wall of the housing; a plurality of holes in the housing configured to correspond with matching holes in the bottom of the door, each hole in the housing including a corresponding one of a screw sleeve, a set screw, and a plastic hole cap.

8. The sweep as described above in claim 7, wherein the housing is aluminum, and wherein the housing is three inches high.

9. The sweep as described above in claim 7, wherein the aperture is a half-inch wide.

10. The sweep as described above in claim 7, wherein the horizontal frame member is set one half inch below the top of the housing.

11. The sweep as described above in claim 7, wherein the pressure plate is aluminum, and wherein the pressure plate is two inches high and a quarter inch thick.

12. The sweep as described above in claim 7, wherein the bundle is a half-inch thick and two and a half inches high.

13. A method of adjusting a door sweep comprising: attaching a housing of the door sweep across a bottom of an exterior of a door, then relaxing a pressure plate holding nylon sweep bristles is position inside the housing by backing off set screws and enabling retracting springs to pull said pressure plate away from the bristles allowing them to drop down gravitationally through an aperture of the housing until each one of the bristles comes in contact with a specific contour of a threshold surface, and retightening the set screws which lock the bristles in place in conjunction with the pressure plate.

14. A method of adjusting a door sweep comprising: incorporating an adjustable door sweep as an integrated component inserted into a bottom of a hollow interior of a door; relaxing a pressure plate holding nylon sweep bristles in position by backing off set screws and enabling retracting springs to pull the pressure plate away from the sweep bristles to enable their deployment, thereby allowing the bristles to drop down gravitationally through an aperture in the housing until each of the bristles comes in contact with a specific contour of a threshold surface; the bristles are then held in place by retightening the set screws, thereby locking the bristles with the pressure plate.

* * * * *